US011517944B2

(12) United States Patent
Della Torre

(10) Patent No.: US 11,517,944 B2
(45) Date of Patent: Dec. 6, 2022

(54) DEVICE FOR CLEANING CYLINDRICAL ROLLERS, MACHINE COMPRISING SAID DEVICE, AND CLEANING METHOD

(71) Applicant: SIMEC GROUP S.R.L., Olgiate Olona (IT)

(72) Inventor: Emilio Alberto Della Torre, Olgiate Olona (IT)

(73) Assignee: SIMEC GROUP S.R.L., Olgiate Olona (IT)

( * ) Notice: Subject to any disclaimer, the term of this patent is extended or adjusted under 35 U.S.C. 154(b) by 266 days.

(21) Appl. No.: 16/720,451

(22) Filed: Dec. 19, 2019

(65) Prior Publication Data

US 2021/0187566 A1 Jun. 24, 2021

(51) Int. Cl.

| | |
|---|---|
| ***B41F 35/00*** | (2006.01) |
| ***B08B 7/04*** | (2006.01) |
| ***B08B 3/10*** | (2006.01) |
| ***B08B 1/00*** | (2006.01) |
| ***A46B 9/06*** | (2006.01) |
| ***A46B 13/04*** | (2006.01) |

(52) U.S. Cl.

CPC ..... *B08B 7/04* (2013.01); *A46B 9/06* (2013.01); *A46B 13/04* (2013.01); *B08B 1/002* (2013.01); *B08B 1/008* (2013.01); *B08B 3/10* (2013.01); *B41F 35/00* (2013.01); *A46B 2200/30* (2013.01)

(58) Field of Classification Search

None

See application file for complete search history.

(56) References Cited

U.S. PATENT DOCUMENTS

| | | | | |
|---|---|---|---|---|
| 4,208,754 | A * | 6/1980 | Hille | C03B 35/168 451/142 |
| 4,729,309 | A * | 3/1988 | Saterini | B41F 5/24 101/352.04 |
| 5,410,961 | A * | 5/1995 | DeNicola | B41F 31/027 101/366 |
| 6,957,607 | B2 | 10/2005 | Biagiotti | |
| 7,428,868 | B2 | 9/2008 | Petri | |

FOREIGN PATENT DOCUMENTS

| | | | |
|---|---|---|---|
| CA | 2161478 | A1 | 4/1996 |
| DE | 102015005535 | A1 | 11/2016 |
| GB | 1328512 | A | 8/1973 |
| JP | H06262758 | A | 9/1994 |
| WO | 1997000173 | A1 | 1/1997 |

OTHER PUBLICATIONS

Machine Translation of JP06-262758 by Shozo Inuyama, published Sep. 20, 1994.*

* cited by examiner

*Primary Examiner* — Mikhail Kornakov
*Assistant Examiner* — Ryan L Coleman
(74) *Attorney, Agent, or Firm* — McGlew and Tuttle, P.C.

(57) ABSTRACT

The cleaning device (20) for cleaning a cylindrical roller (50), for example an anilox roller of a printing machine, includes a cleaning head (30) with a cleaning chamber (110), in which there is housed a mechanical cleaning member (60), and with which there are associated feeding members (70) for feeding a cleaning liquid into the cleaning chamber (110). The mechanical member (60) and cleaning liquid dispensed by the feeding members work in combination inside said cleaning chamber (110) to clean the lateral surface of the roller (50).

25 Claims, 14 Drawing Sheets

30
20
217
61
217
Y
215
211
213
X
210

DEVICE FOR CLEANING CYLINDRICAL ROLLERS, MACHINE COMPRISING SAID DEVICE, AND CLEANING METHOD

TECHNICAL FIELD

The present invention relates to a device for cleaning cylindrical rollers, with smooth or engraved surfaces, in particular rollers for printing machines, fluid transfer rollers or the like, such as anilox rollers, cliché rollers, spreader rollers, finishers, laminators or other.

The invention also relates to a method for cleaning a roller.

BACKGROUND ART

Machines for printing web materials, such as, but not limited to, plies of tissue paper, are subject to frequent downtimes to allow cleaning of the rollers, as ply material tends to easily deposit small particles or fibers of material that, being in contact with the printing liquid (ink), soil or fill the small cells that transfer the ink.

These cells, which form the outer surfaces of the transport roller (also called anilox roller), must be kept clean and free from deposits, in order to best perform their function.

In fact, the liquid transferred, also becoming contaminated with debris from the web material to be printed, tends to stratify inside the cells used to transport the liquid, thereby reducing their capacity. This leads to a variation of the technical and/or visual features of the web material, for example due to a decrease in the density of the printing ink.

The frequent halts in the production line required to clean the rollers represent the main reason for loss of efficiency of the line.

Depending on the application field and type of printing machine, the characteristics of the rollers can vary, as can their structure. Therefore, machines have been designed that allow rapid removal of the rollers, in this way allowing them to be washed and cleaned off-line.

In other cases, situations can occur in which the removal of the roller would require very long disassembly, cleaning and reassembly times, for example in the field of rollers for processing corrugated cardboard.

Due to this variability, cleaning systems that operate off-line, i.e., systems in which the roller to be cleaned is disassembled from the production machine, as well as cleaning systems that are installed in-line, i.e., on the production machine, have been developed.

The cleaning systems currently available on the market can be summarized as follows:

manual systems with brushes, which allow the operator to clean the roller by rubbing it with the addition of chemical products. These systems do not guarantee the uniformity of the process and frequently do not comply with the current safety regulations;

Sodium bicarbonate systems, both in-line and off-line versions. These are efficient as regards the process, but very complex as regards management of the machine and of the product (baking soda) used, not always available with the ideal characteristics for the cleaning process;

laser systems applicable in-line or off-line. These systems are very costly and require the use of highly skilled personnel to avoid damaging the roller to be cleaned;

high-pressure water jet machines;

washing systems with dry ice;

washing systems using only chemical products. These can operate in-line and off-line. In the first case, the ink must be replaced. This system has the drawback that the cleaning liquid comes into contact with all the machine components and, being very aggressive, may damage some of the components. Moreover, the action of the cleaning liquid is not combined with a mechanical action. Therefore, in order to be effective, in addition to the use of an aggressive liquid, the washing operation also requires very long performance times.

In the case of off-line systems, the roller to be cleaned must be removed from the production line and machines used to clean it are very cumbersome.

Prior art cleaning systems are not sufficiently fast and reliable. In fact, known cleaning systems make use of consumables that are wasteful, polluting and have a high environmental impact (also for the operators in the immediate vicinity), or that do not guarantee satisfactory results in reasonable times.

Known cleaning systems, which use jets of cleaning liquid directed at a roller of a printing machine are disclosed in U.S. Pat. Nos. 7,428,868; 6,957,607; WO1997000173.

Therefore, there is the need to produce cleaning devices for cylindrical rollers that completely or partially solve one or more of the problems of the prior art devices.

SUMMARY

The main object of the present invention is to provide a device that is fast, reliable and inexpensive, with regard to the cost of the system and the cost of the consumables.

The object of some embodiments is to obtain a cleaning device that can be easily installed, both in-line (i.e., on the machine) and off-line, in any working environment and without requiring particular safety equipment, as it has a small size, low weight, limited consumption of material and reduced cleaning cycle performance times. This means it can also be installed on existing machines with a quick replacement of existing devices, or added to plants without cleaning devices.

According to a first aspect, there is provided for this purpose a cleaning device comprising a cleaning head with a cleaning chamber, in which a mechanical cleaning member is housed, and with which feeding members are associated for feeding a cleaning liquid into the cleaning chamber. With this layout, the mechanical member and the cleaning liquid dispensed by the feeding members work in combination inside the cleaning chamber to clean the cylindrical surface of the roller to be cleaned.

To clean rollers of considerable axial length with a device of limited dimensions, according to advantageous embodiments the cleaning head is provided with a translation movement in a direction parallel to the axis of the cylindrical roller. The combination of the rotation movement of the roller and the translation movement of the cleaning head allows the whole of the cylindrical surface of a roller, even with considerable radial and/or axial dimensions, to be washed efficiently in a small space.

In advantageous embodiments the cleaning head can be provided with a movement toward and away from the roller. The movement can be in an axial direction, i.e., can be such as to move the head away beyond an axial end of the roller. However, in preferred embodiments, the movement of the cleaning head toward or away from the lateral surface of the roller is orthogonal to the rotation axis of the roller, or in any case a movement that has at least one component orthogonal to the axis of the roller.

To obtain efficient washing, the cleaning head and, together with it, the mechanical cleaning member can be moved with respect to the lateral surface of the roller to be washed, maintaining the contact between mechanical cleaning member and surfaces of the roller. However, for more efficient washing and to reduce mechanical stresses on the components of the device, advantageously the mechanical cleaning member is provided with a movement inside the cleaning chamber, movement that does not involve the remaining parts of the cleaning head.

In some embodiments, this movement can be a rotation movement. For example, the mechanical cleaning member can comprise a rotating brush, or preferably two counter-rotating brushes.

In currently preferred embodiments, the movement of the mechanical cleaning member is a reciprocating movement, preferably in a direction parallel to the rotation axis of the roller.

To delimit the cleaning chamber, the cleaning head can comprise lateral sealing gaskets. These lateral sealing gaskets can have concave edges, with a curvature corresponding to, or slightly lower than that of the roller to be cleaned, so as to embrace the roller if necessary with a slight elastic deformation of the gaskets, to improve the lateral seal.

The lateral sealing gaskets can be replaceable as a function of the diameter of the roller to be cleaned. For example, the lateral sealing gaskets can be housed in respective side elements that form lateral walls of the cleaning chamber. The side elements can be adapted to house the lateral sealing gaskets of variable dimensions, as a function of the variable diameter of said roller to be cleaned.

For efficient closing of the cleaning chamber, in some embodiments the cleaning head comprises an upper sealing blade and a lower sealing blade, adapted to delimit the cleaning chamber above and below. In advantageous embodiments the blades can be biased against the roller to be cleaned to improve the seal. For this purpose, the blades can be elastic, or can be associated with pressure members, such as piston-cylinder actuators, or springs or other elastic biasing members.

The mechanical cleaning member can comprise at least one brush.

According to a further aspect, the present invention also relates to a machine comprising a cylindrical roller to be cleaned and a device as defined above and as better described below with reference to examples of embodiment.

According to yet another aspect, the invention relates to a method for cleaning a roller, comprising the following steps:

moving, toward a lateral cylindrical surface of the roller, a cleaning head comprising a cleaning chamber open toward the cylindrical surface of the roller and containing therein a mechanical cleaning member and feeding members of a cleaning liquid into the cleaning chamber;

bringing the mechanical cleaning member into contact with the lateral cylindrical surface of the roller to be cleaned, so as to substantially close the cleaning chamber from the front side;

moving the mechanical cleaning member into contact with the lateral surface of the roller dispensing cleaning liquid into the cleaning chamber.

Further aspects and embodiments of the device and of the method according to the present invention are described hereunder with reference to the accompanying drawings and are defined in the appended claims, which form an integral part of the present description.

BRIEF DESCRIPTION OF THE DRAWINGS

The present invention will be better understood with reference to the accompanying figures, which show an application, but without limiting the scope of the present invention. In the accompanying drawings.

DETAILED DESCRIPTION

Hereunder the cleaning device is described in combination with an anilox roller of a printing machine. However, it must be understood that a cleaning device of the type described here can also advantageously be applied to clean other rollers affected by similar problems.

Figure 1:
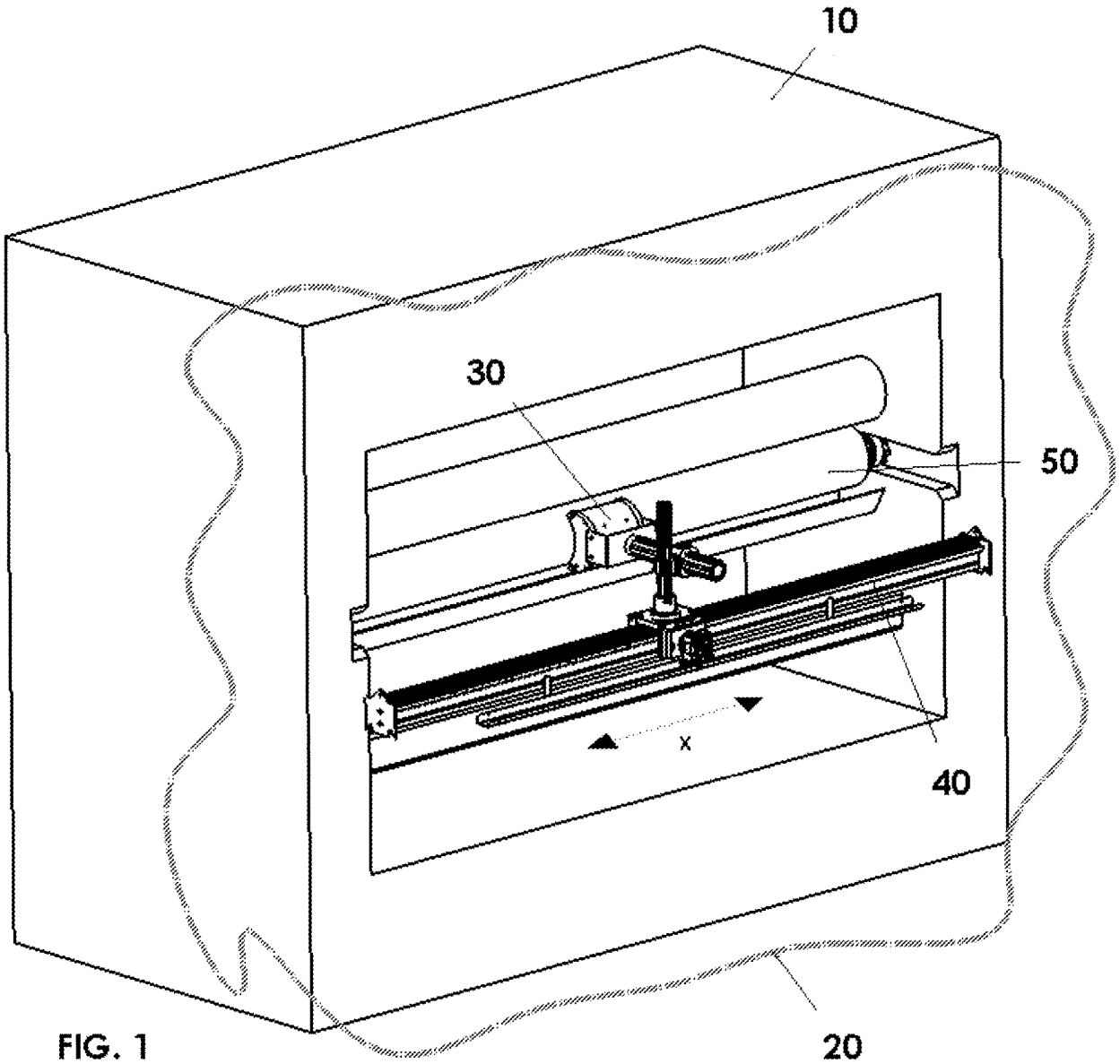
FIG. 1 shows an overall view of an embodiment of the device of the present invention, installed on a printing machine.

FIG. 1 shows an overall view of a printing machine generically indicated with 10, for example destined for printing and decorating a ply web material (not shown), which houses a cleaning device 20 of the invention. The cleaning device 20 is essentially composed of two parts, indicated respectively with 30 (cleaning head) and 40 (movement assembly).

The cleaning head 30 acts, in the example illustrated, on an anilox roller 50, which has on the surface a coating made of a hard material, for example a ceramic material, engraved with small cells, which transport the printing liquid, typically an ink. These cells (not shown) can become at least partially clogged with debris consisting of particles of paper and ink. When this occurs the anilox roller 50 becomes unusable and requires a cleaning operation. For this purpose, the cleaning head 30 is brought into close proximity of the anilox roller 50 and subsequently made to translate in a direction parallel to the axis of the roller 50, as better described below.

Figure 3A:
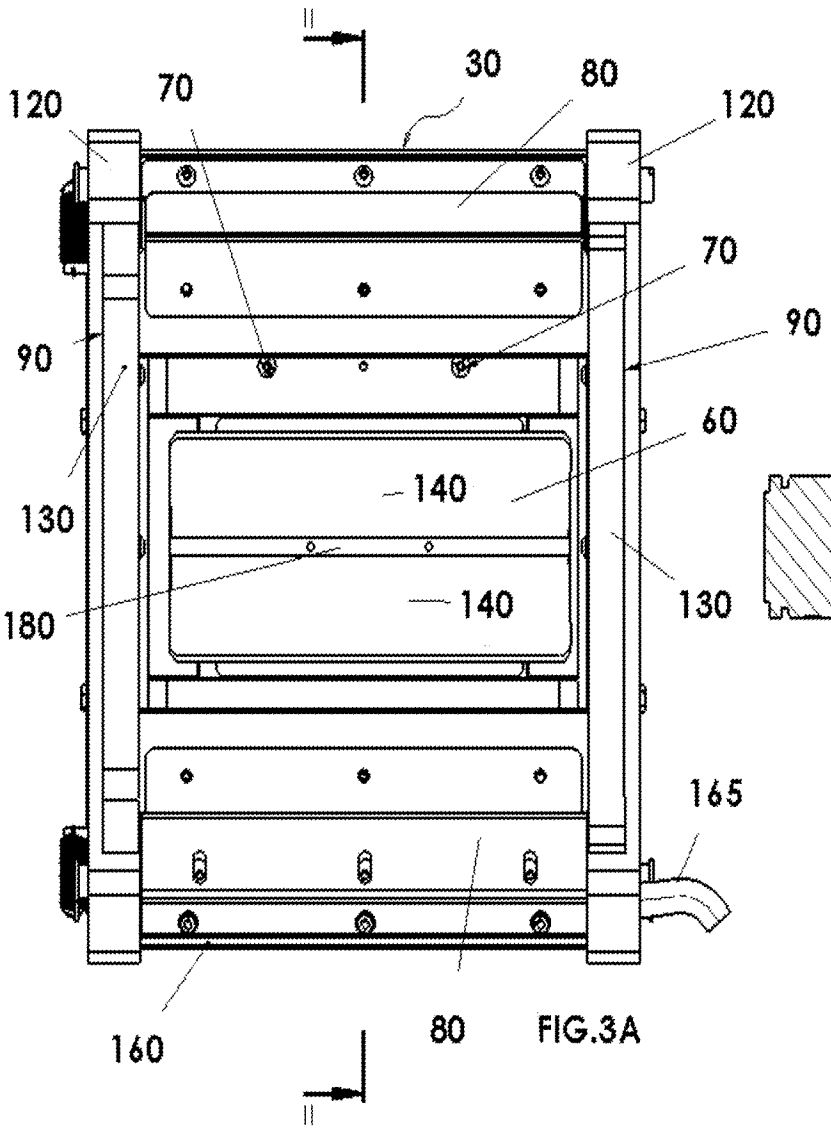
FIG. 3A shows a front view of the cleaning head of FIG. 2.
Figure 3B:
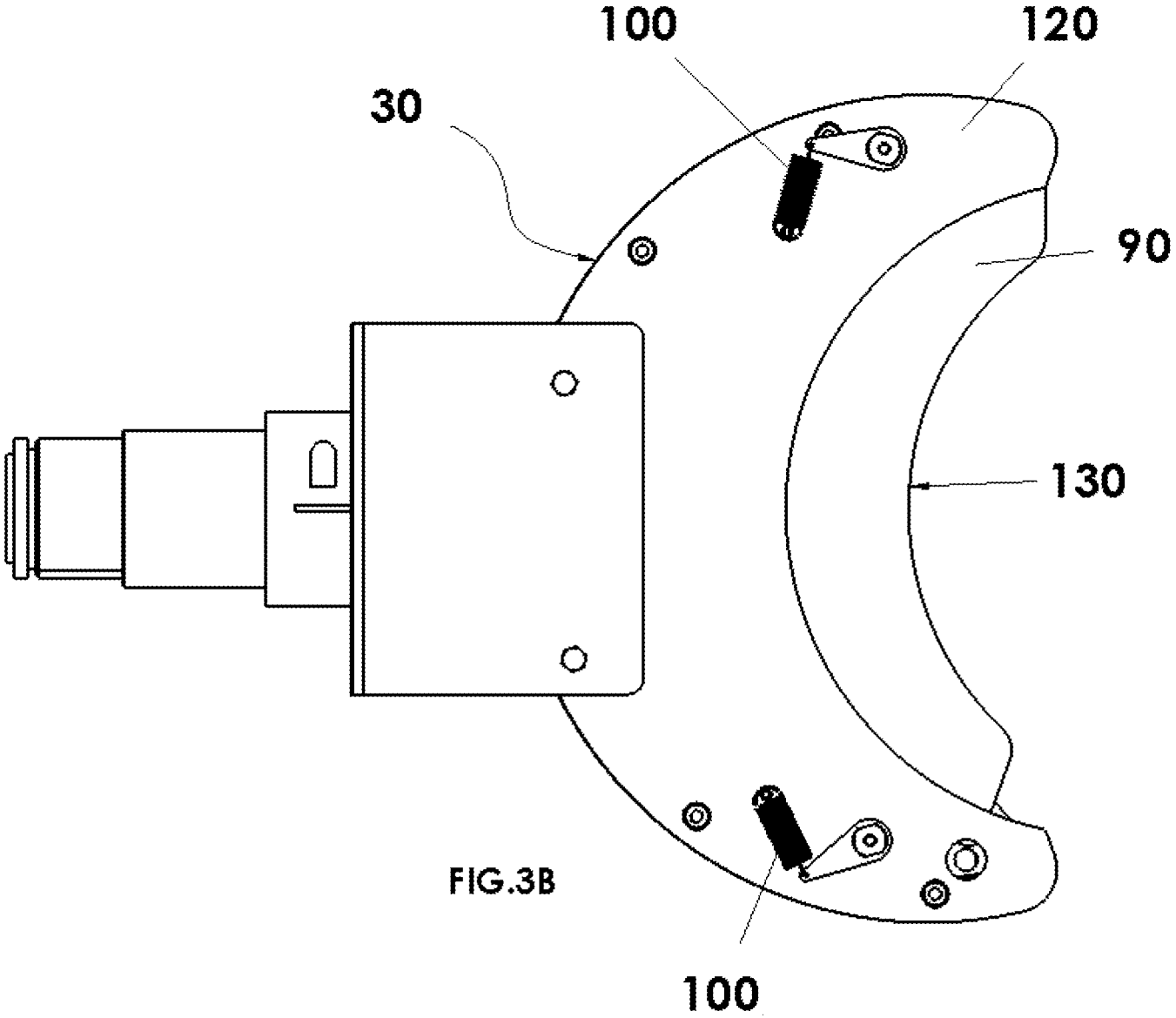
FIG. 3B shows a lateral view of the cleaning head.
Figure 3C:
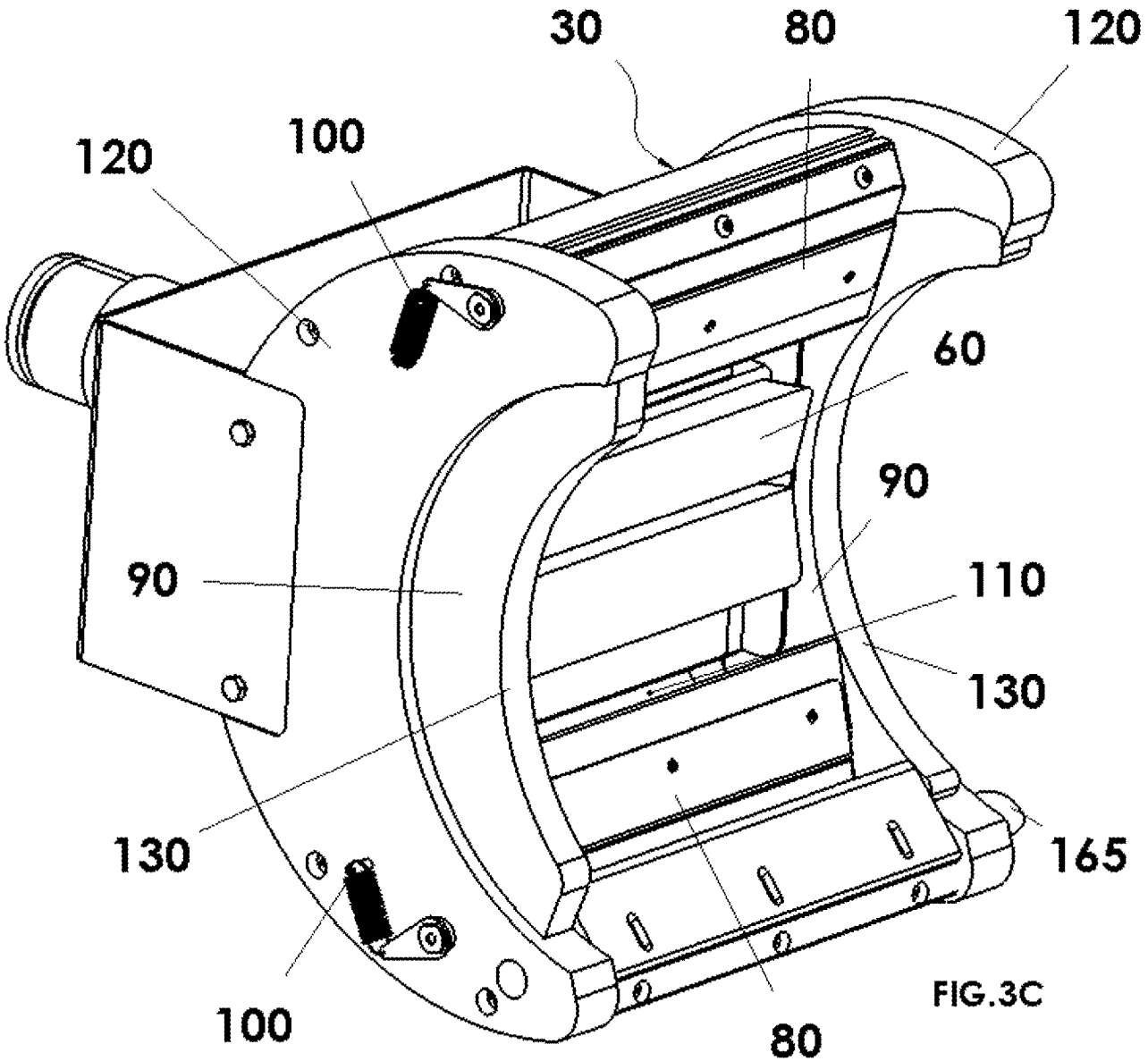
FIG. 3C shows an axonometric view of the cleaning head.

With reference to FIGS. 3A, 3B, 3C, the cleaning head 30 comprises various components, including a mechanical cleaning tool 60, which can be a brush or the like. The cleaning head further comprises a pair of nozzles 70 for spraying a cleaning liquid, upper and lower sealing blades 80 and lateral sealing gaskets 90. When the cleaning head 30 is in the operating position and coacts with the anilox roller 50, the assembly made up of the upper and lower blades 80 and of the sealing gaskets 90 forms, together with the cylindrical surface of the roller 50, a fluid tight cleaning chamber 110.

In advantageous embodiments, the blades 80 are adjustable and held with pressure against the roller 50 to be cleaned through the use of compression members 100

(FIGS. 3B, 3C) exemplified here in the form of springs, which allow fluid tightness in the upper and lower part of the cleaning chamber 110 also when the there is a variation in the diameter of the roller 50 to be cleaned, as the blades 80 are always in contact and with a certain pressure against the roller 50.

The sealing gaskets 90 are supported by respective side elements 120 that, in the same way as the blades 80, can accommodate gaskets 90 of different dimensions, or rather with a concave profile 130 adapted to the variable diameter of the roller 50. This means that, with the same cleaning head 30 and the same side elements 120 it is possible to clean rollers 50 with various diameters, as the cleaning chamber 110 will in any case remain exempt from seepages or leakages of liquid, due to the spring adaptability of the blades 80 and to simple replacement of the sealing gaskets 90.

More specifically the blades 80 can be substantially rigid and can adapt to the dimension of the roller 50 by pivoting around a hinge axis under the action of the approaching roller 50 and under the action of a spring, such that the free edge of the blades 80 can be urged elastically, e.g. by springs 100, against the outer cylindrical surface of the roller 50. Also the gaskets 90 can be substantially rigid. The profile 130 of the gaskets 90 is shaped to match the outer cylindrical surface of the roller. As used herein the term "substantially rigid" means that it does not deform under the load applied by the roller during the cleaning operation.

The above described arrangement allows efficient cleaning and flexible adaptation to rollers of variable diameter.

Figure 6:
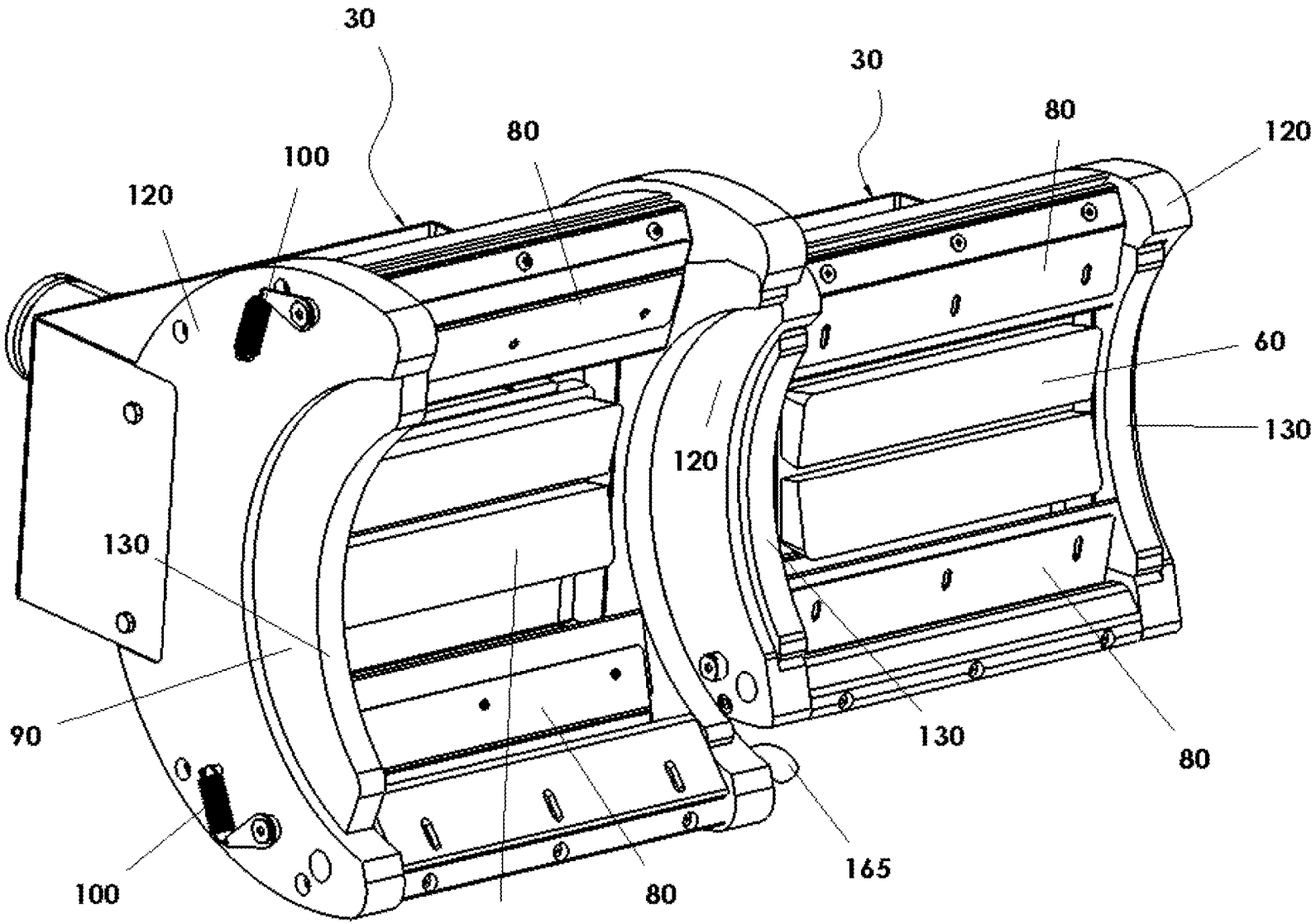
FIG. 6 shows an axonometric view of two cleaning heads with the same function but with different dimensions.

As the variation of the diameter of the rollers 50 to be cleaned ranges from around 150 mm to around 300 mm, in some embodiments the side elements 120, and with these elements the whole cleaning head 30, can cover roughly half of the range indicated above. This means that it will be possible, for example, to have a first cleaning head 30, and respective side elements 120, to install on the cleaning device 20 for rollers 50 of diameter comprised between around 150 mm and around 220 mm, and a second different (larger) cleaning head 30 with side elements 120 of a size which is larger than previous ones, for rollers 50 with a diameter comprised between around 220 mm and around 300 mm. FIG. 6 shows, in an axonometric view, compared with each other, two cleaning heads 30 of different dimensions to cover the whole range of diameters of the roller 50 to be cleaned.

In this way with two different cleaning heads 30, with dimensions different from one another, it will be possible to perform cleaning of rollers 50 with any diameter comprised between around 150 mm and around 300 mm. In fact, it will be sufficient to install on the cleaning device 20 the head 30 with larger or smaller side elements 120 depending upon the diameter of the roller 50 to be cleaned.

In the case of a small variation in the diameter of the roller 50 it will not be necessary to change the side elements 120, but it will be sufficient to replace the sealing gaskets 90 corresponding to the new diameter of the roller 50 to be cleaned.

As mentioned above, a mechanical cleaning member, in this case a brush 60, is arranged inside the cleaning chamber 110. Advantageously, the brush 60 is translated with a reciprocating movement in a direction parallel to the axis of the roller 50. In this way, the combined action of the liquid injected at low pressure by the nozzles 70 and the reciprocating movement of the brush 60 allows fast, efficient and low cost cleaning of the cylindrical surface of the roller 50. In the illustrated example, the movement of the brush or other mechanical cleaning member 60 is obtained with an actuator, for example a pneumatic motor 61, and the motion is transmitted, for example, through a cam and eccentric or the like, indicated schematically with 62, although it would also be possible to use other systems known in the art.

Figure 4:
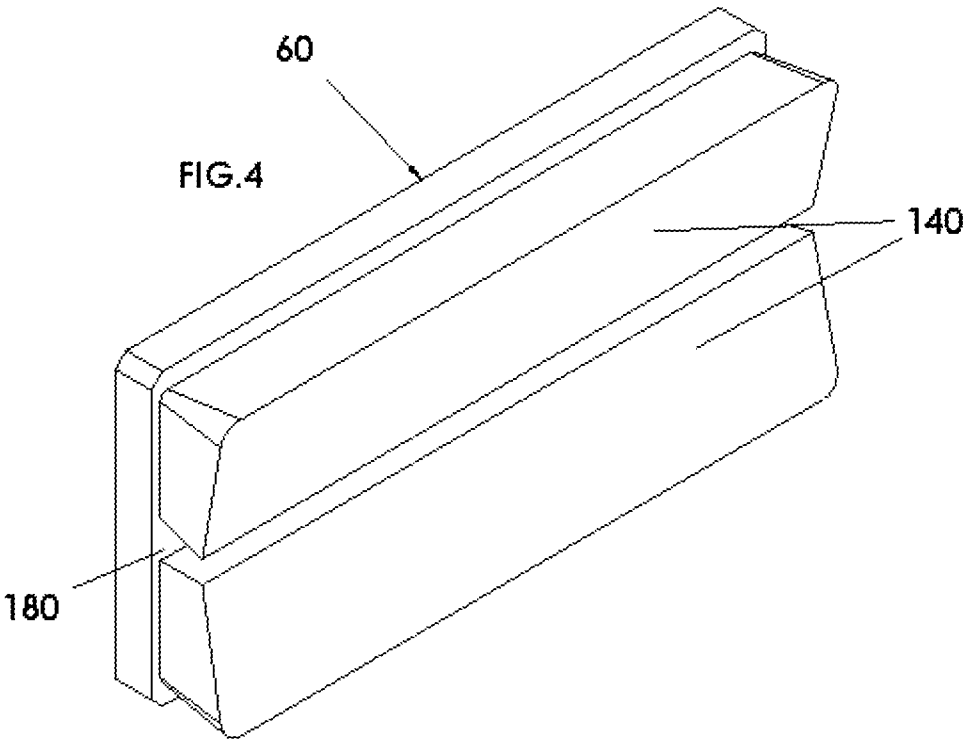
FIG. 4 shows an axonometric view of the mechanical cleaning member.

In some embodiments, the brush 60 is advantageously formed of two parts 140 (FIG. 4) extending in transverse direction (parallel to the axis of the roller 50), so as to leave a channel 180 between the two parts 140. In this way, a small amount of cleaning liquid coming from the nozzles 70 is maintained in direct contact both with the roller 50 and with the bristles forming the two parts 140.

Figure 2:
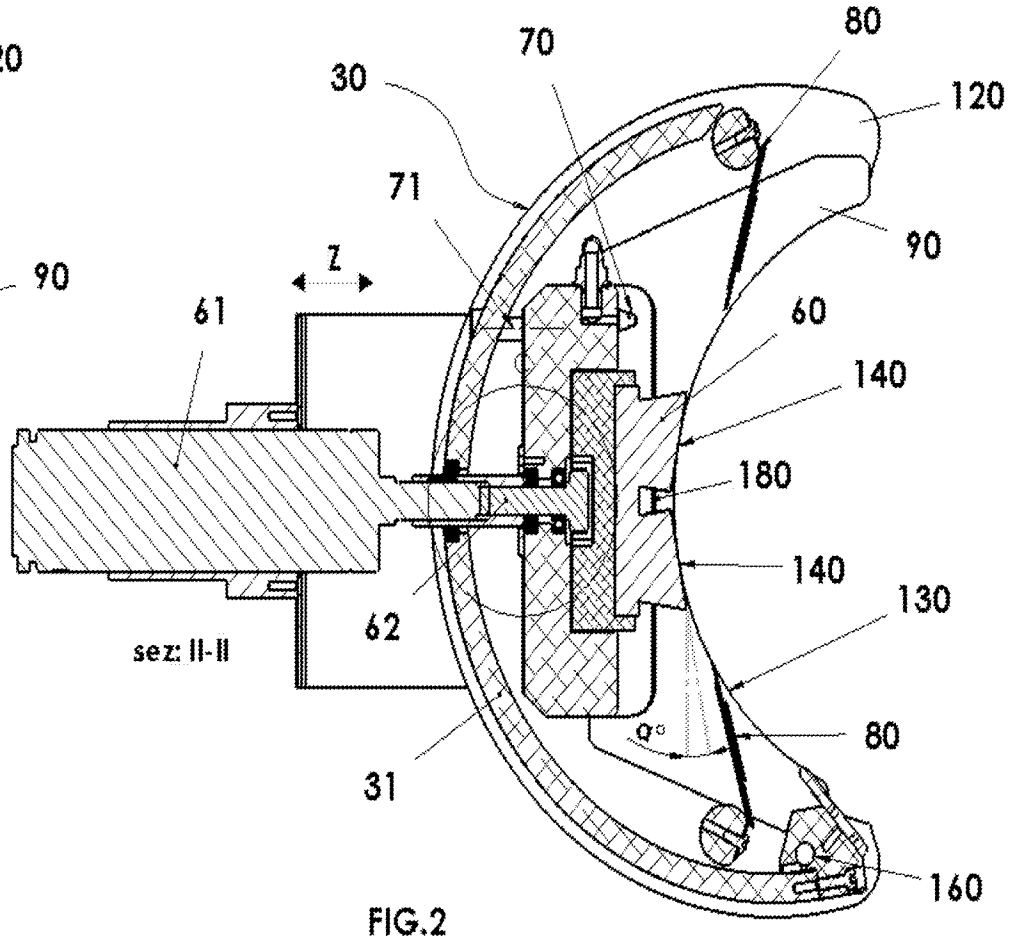
FIG. 2 shows a partial sectional view of the cleaning head of the device obtained according to II-II of FIG. 3.

The two parts 140 of the brush 60 advantageously have a dovetail shape (see in particular FIGS. 2 and 5), so as to bring the bristles of the two parts 140 as close as possible to the roller 50 to be cleaned, and to create an obligatory path for the cleaning liquid (maximizing the contact time of the cleaning liquid on the roller and consequently its removal efficiency).

Figure 5:
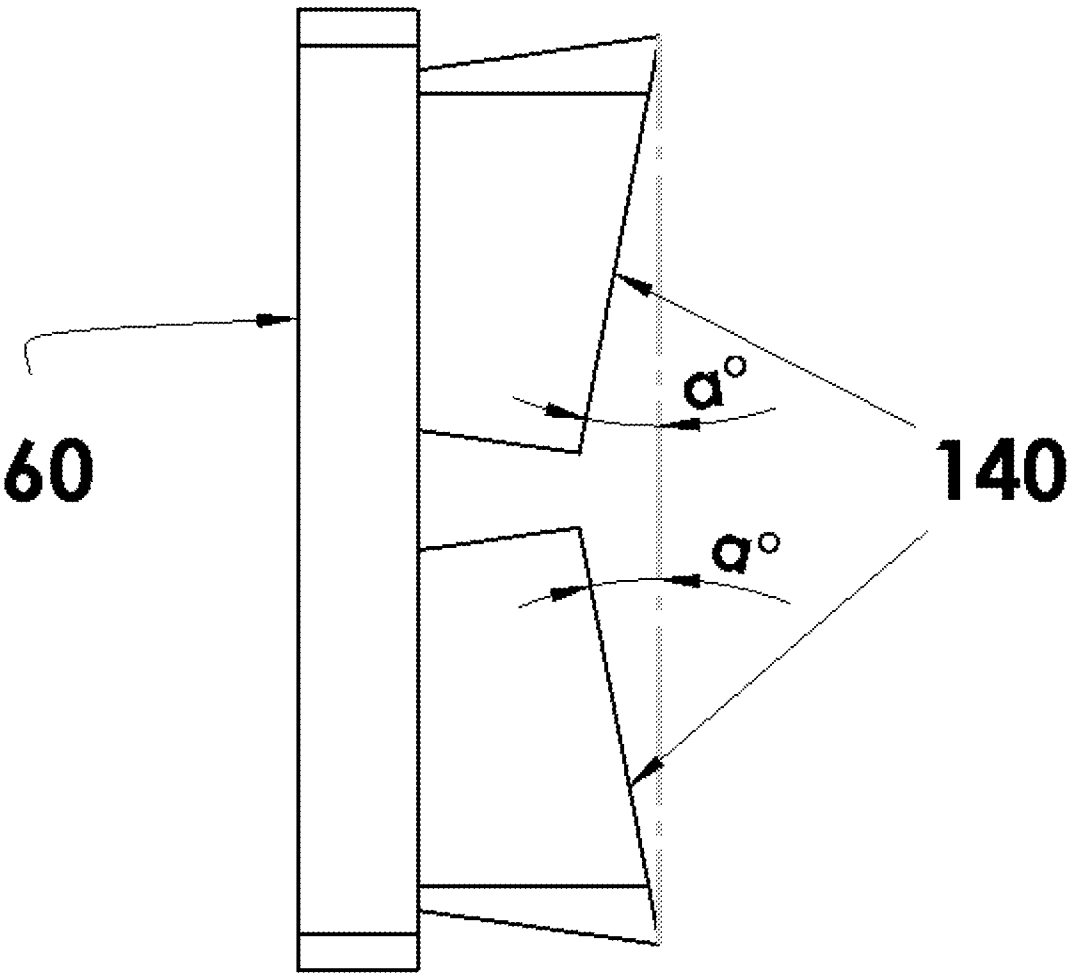
FIG. 5 shows a lateral view of the mechanical cleaning member of FIG. 4.

More in particular, as shown in FIG. 5, each of the two parts 140 of the brush 60 has a surface (for example formed by the tips of the bristles that make up each part 140 of the brush 60) that form an angle $\alpha$ with a vertical plane. The angle $\alpha$ can for example be from around 5° to around 20°, preferably from around 10° to around 15°, preferably of around 12°. The aforesaid inclined surfaces of the parts 140 of the brush 60 are inclined in opposite directions, so as to be arranged, in substance, on the two sides of a "V" with opening (180-2*a*) degrees, so that the two parts 140 of the brush 60 embrace the cylindrical surface of the roller 50 as much as possible.

The brush 60 can be provided with bristles of different thickness and material, for example the bristles can have dimensions comprised between 0.05 and 0.5 mm, advantageously between 0.1 and 0.2 mm and be made of filaments of brass, steel, plastic or animal material, or the like. The aforesaid parameters and materials can vary as a function of the shape and of the material of the surfaces to be cleaned, and of the pressure required and expected useful life of the bristles. It would also be possible to use brushes 60 provided with mixed bristles, i.e. made of different materials, for example harder and softer bristles, which can have various arrangements. For example, clumps or groups of bristles of a first type can be arranged alternated with clumps or groups of bristles of a second type.

To be able to adapt to rollers 50 to be cleaned with different diameters, the brush 60 can be supported so that it also slides in a direction (indicated with Z in FIG. 2) toward the roller 50 to be cleaned. This forward movement according to the direction Z has the dual purpose of offsetting any differences in the diameter of the roller 50 to be cleaned, and of adjusting the pressure exerted by the bristles 140 on the roller 50. This latter characteristic can also be exploited to offset partial wear of the bristles, so that the effectiveness of the action of the brush 60 remains more or less constant, extending the useful life of the brush 60. The number 71 (FIG. 2) indicates a fixing and adjustment column, along which the cleaning head 30 can translate to move toward the axis of the roller 50.

For the same reason, the cleaning head 30 can be supported by an arm (not shown) adjustable in length, so that the seal of the blades 80 and of the sealing gaskets 90 is guaranteed against seepage of cleaning liquid and of any residues removed from the roller 50.

As mentioned initially, the cleaning head 30 (see. FIG. 1) is mounted on a movement assembly 40 that controls translation of the cleaning head 30 in a direction parallel to the axis of the roller 50. The movement is indicated by the double arrow X in FIG. 1 and is advantageously a two-way movement, so that the cleaning head 30 can translate in the two directions to act on the whole cylindrical surface of the roller 50. The translation movement can be imparted to the head 30 by any known movement system. In the case shown, a rack and pinion system is used, but it would be possible to use other known systems, for example with belt and pulley, with gears, with recirculating ball screws or the like.

In some embodiments, one or more holes 160 (FIG. 2) are arranged in the lower part of the cleaning chamber 110, connected to which are pipes 165 (FIG. 3A) for collecting and recovering the cleaning liquid and any debris detached from the roller 50. Evacuation of the remaining cleaning liquid and of any debris can take place through gravity or vacuum, both induced from the outside, or through slight overpressure that is created in the cleaning chamber 110.

The lateral sealing gaskets 90 can be housed in respective seats, obtained in negative in the side elements 120, so that the gaskets 90 with concavity 130 with different diameters (to operate on rollers 50 with different diameters), can in any case be installed on the same side elements 120. This makes the cleaning head 30, and hence the whole cleaning device, extremely versatile. Moreover, the shape of the gaskets 90 is such that they are very easy to replace without the aid of particular tools.

In fact, as described above, simply by replacing the sealing gaskets 90, it is possible to obtain effective cleaning of rollers 50 with very variable diameters, for example in a range comprised between around 150 and around 220 mm, or between around 220 and around 300 mm. Advantageously, also the blades 80 contribute to this flexibility of the device, as for the aforesaid range of diameters of the roller 50 to be cleaned, the simple action of the springs 100 (FIG. 3A) is sufficient to guarantee the seal in the direction of rotation of the roller 50, both in the upper part and in the lower part of the cleaning chamber 110.

The lateral sealing gaskets 90 can be made of different materials, provided the material has sufficient resistance to sliding friction and does not overheat. A particularly suitable material has proven to be "EVA" closed cell expanded polyethylene, with a density comprised between 50 and 120 $kg/m^3$. However, it would also be possible to use other materials with similar or improved characteristics with respect thereto.

The device described above functions as follows.

The cleaning head 30 of the device 20 is brought into close proximity of the roller 50 to be cleaned. A slight forward movement of the head 30 in the direction of the roller 50 causes closing of the cleaning chamber 110, delimited laterally by the sealing gaskets 90, which can have the concave front part 130 with a radius of curvature equal to or slightly smaller than the radius of the roller 50. The sealing gaskets 90 can be moved toward the roller 50 with a slight pressure against the cylindrical lateral surface of said roller 50. The cleaning chamber 110 is delimited on top and on the bottom by the blades 80 held with pressure against the roller 50 by the springs 100 or another suitable member, for example another elastic member, a piston-cylinder actuator or other suitable means. Thanks to the particular structure of the blades 80 and of the gaskets 90 that the cleaning chamber 110 remains sealingly closed regardless of the direction of rotation of the roller 50. The cylindrical surface of the roller 50 completes the front closing of the cleaning chamber 110, while a wall 31 (FIG. 2) of the cleaning head 30 closes it at the rear.

After the forward movement and sealing of the cleaning chamber 110, the brush 60, with its bristles 140 coming into contact with the surfaces of the roller 50 to be cleaned through the forward movement of the head 30 toward the roller 50, starts to move inside the cleaning chamber 110 in a direction transverse to the roller, i.e., parallel to the axis thereof, so as to cause the bristles of the brush 60 or other mechanical cleaning member to rub against the surfaces of the roller 50 to be cleaned.

Simultaneously, the nozzles 70 inject cleaning liquid, which can consist of water, a solution of water and detergent, or another liquid product with a cleansing action. The combined action of rubbing of the bristles of the brush 60 and of the cleaning liquid, ensure that the portion of surfaces of the roller 50 to be cleaned involved and circumscribed by the cleaning chamber 110 is easily cleaned. The particles of paper, ink, or any other processing residues that have deposited in the cells of the roller 50 are easily removed. The used cleaning liquid flows downward, thus drawing the debris toward the hole or holes 160, from where it is removed through the pipe or pipes 165. The supply and removal of the cleaning liquid can take place discontinuously or preferably continuously.

In particular cases, for example in case of particularly stubborn dirt, it is possible to use a heated cleaning liquid, so that it is even more effective on the dirt to be removed. The cleaning liquid can be water or any cleaning product, pure or diluted, and can be heated, for example, to a temperature comprised between 25° C. and 50° C., preferably between 30° C. and 45° C.

To perform cleaning of the whole cylindrical surface of the roller 50 it is sufficient to rotate the roller 50 to cover the entire circumference thereof. Through a simple translation of the cleaning head 30 in the direction X (FIG. 1), parallel to the axis of the roller 50, it is possible to gradually clean the various annular portions of the roller from one end to the other. By providing an operation with continuous movements, i.e. with continuous rotation of the roller 50 and continuous translation of the cleaning head 30, fast and efficient cleaning can be obtained with a simple device, which requires a small operating space around the roller 50 to be cleaned.

Figure 7:
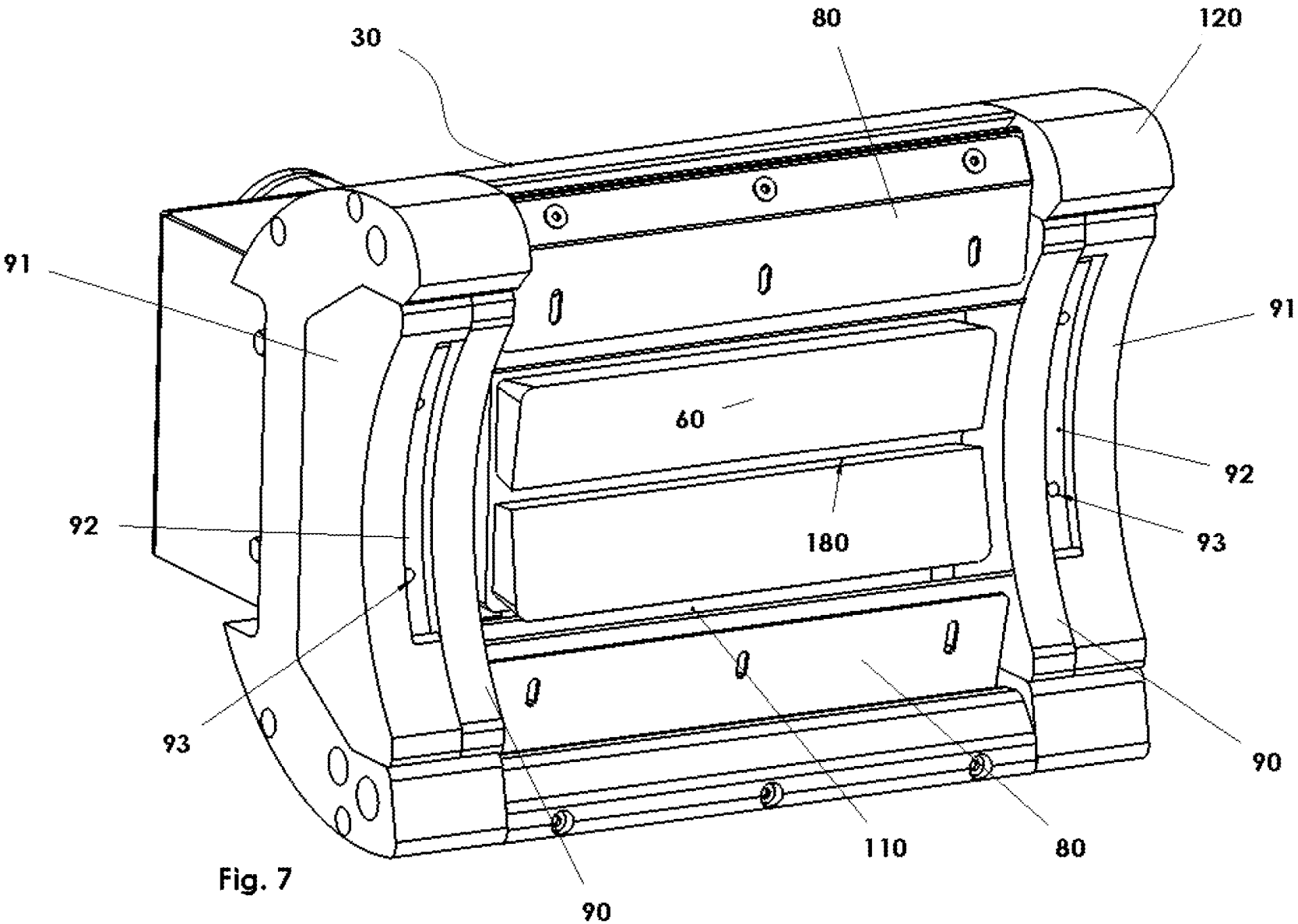
FIG. 7 shows an axonometric view of a further embodiment of the cleaning head, with lateral rinsing chambers.

According to further embodiments, the cleaning head 30 can be provided with means to prevent or limit the lateral seepage of cleaning liquid during use. For example, FIG. 7 shows a configuration of cleaning head 30 with double containment chamber. The same numbers indicate the same or equivalent parts to those already described with reference to the preceding figures, which will not be described again. The main difference between the cleaning head 30 of FIG. 7 and those illustrated in the preceding figures substantially consists in that a further lateral sealing gasket 91, adjacent to the respective sealing gasket 90 described above, is added laterally on the left and right sides of the cleaning head 30.

An empty chamber 92 is formed between the two lateral gaskets 90, 91 of each side of the cleaning head 30. Nozzles 93 for feeding a rinsing liquid, for example water, flow into said chamber 92.

With this configuration of the cleaning head 30 it is possible to manage both the cleaning step of the roller 50 by means of liquid detergents, and the subsequent rinsing step.

It would also be possible to add, if necessary, in a further lateral chamber for each side, a suction system of the cleaning liquid and/or of the rinsing liquid.

Summarizing, the advantages that can be obtained with embodiments of the device according to the present invention are:

the cleaning process can combine the action of any chemical detergent with the action of a mechanical member;

with the same process effectiveness, the system is less expensive than existing systems;

it is possible to process any engraving profile and up to very high line counts (600 lines/cm);

there are no dispersions of cleaning product;

the amount of cleaning product used is very small;

with the same process effectiveness, the system is faster than existing systems;

it can be used in any working environment without the operator requiring particular protective and/or safety equipment;

it is very simple to use and the operator does not require to have any particular training.

While in FIG. 1 the cleaning device 20 is arranged on a printing machine, in other embodiments the cleaning device 20 can be arranged on a cleaning machine, i.e. on a machine the purpose whereof is just to clean rollers, for instance intended to be used for cleaning rollers from one or more different printing machines or the like. It would thus be possible, for instance, to provide a single cleaning machine serving a plurality of printing machines at the same time. A single cleaning unit or device 20 would then be exploited more efficiently to clean a larger number of rollers from several printing lines.

An embodiment of a cleaning machine 200 including a cleaning device 20 as described above is illustrated in FIGS. 8, 9 and 11. The cleaning machine 200 can be adapted to clean a roller 50, for instance a roller of a printing machine. The roller 50 can be an anilox roller, or a cliché roller or the like.

The cleaning machine 200 comprises a supporting structure, adapted to support a cleaning device 20 including a cleaning head 30. The cleaning machine 200 further includes supporting devices for rotatingly supporting a roller to be cleaned as well as a driving unit to drive the roller into rotation around the axis thereof during cleaning. The cleaning head 30 can be configured as described above in connection with FIGS. 1 to 7. The structure of the cleaning head 30 will therefore not be described again.

The cleaning machine 200 can be movable, for instance by means of wheels 201. In the exemplary embodiment of FIGS. 8 to 10 the cleaning machine 200 includes four pivoting wheels 201. The cleaning machine 200 can be adapted to be moved manually or by means of a mover, such as a self-propelled vehicle. In other embodiments, the cleaning machine 200 may be equipped with its own motor, such as an electric motor.

The cleaning machine 200 further includes two end units 203, 205 connected to one another, e.g. by beams 207.

In some embodiments the cleaning head 30 is movable between the two end units 203, 205 in a direction parallel to beams 207 according to double arrow X.

Reciprocating movement of the cleaning head 30 according to arrow X can be controlled by an electric motor 210. The cleaning head 30 can be positioned on a slide 211, which also carries the electric motor 210. The driving shaft of the electric motor 210 can be provided with a pinion meshing with a rack 213, which extends parallel to the beams 207 and to a guide 215 along which the slide 211 moves under the control of electric motor 210. Instead of an electric motor, a pneumatic motor, a hydraulic motor or any other suitable driver can be used. Also, a linear motor, such as a linear electric motor can be used instead of a rotating motor 210 and relevant rack-and-pinion transmission. Other mechanical transmissions can be provided, instead of a rack-and-pinion transmission, for instance a threaded bar meshing with a nut.

Figure 8:
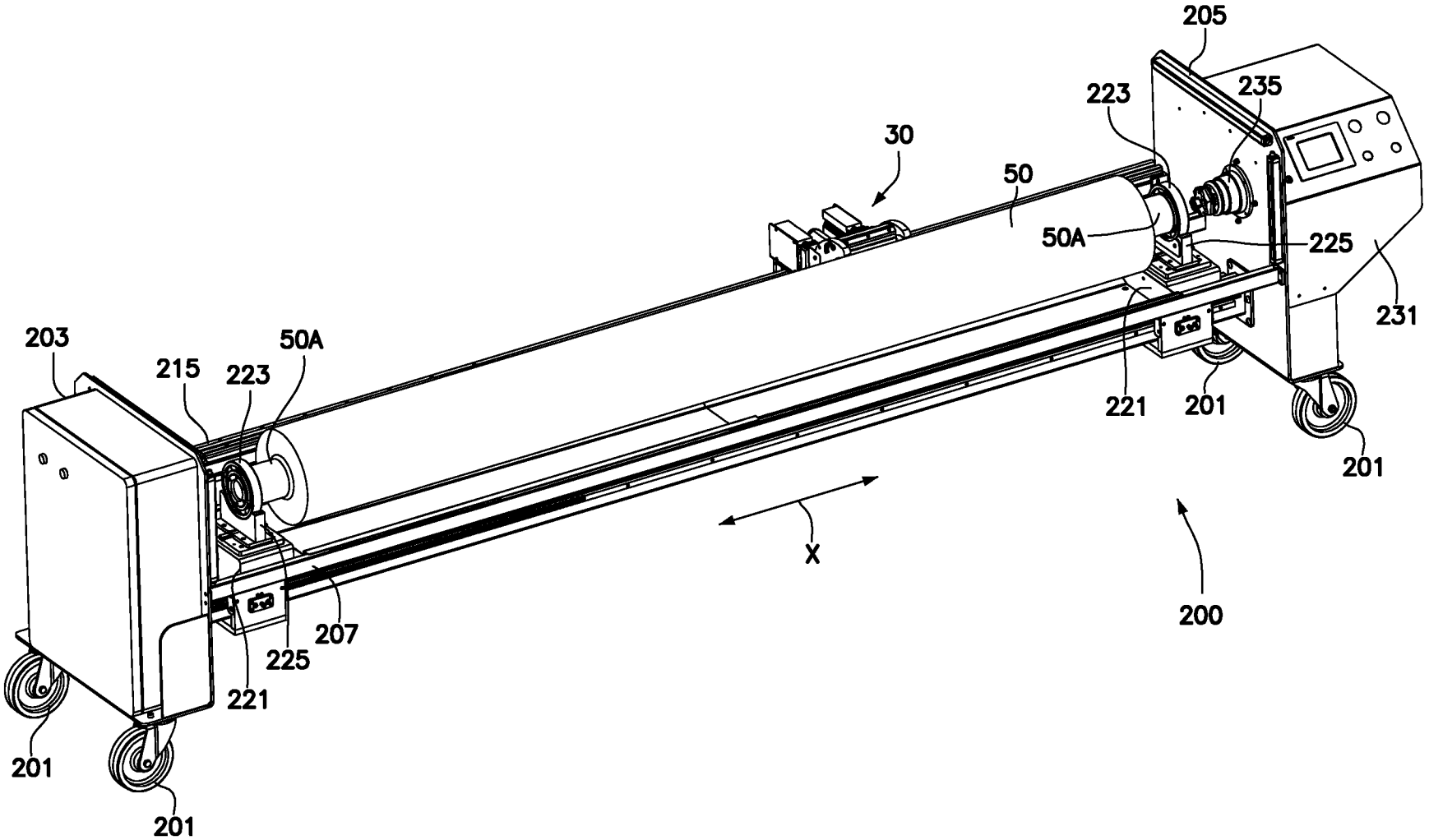
FIGS. 8 and 9 are two isometric views of a machine according to a further embodiment.
Figure 9:
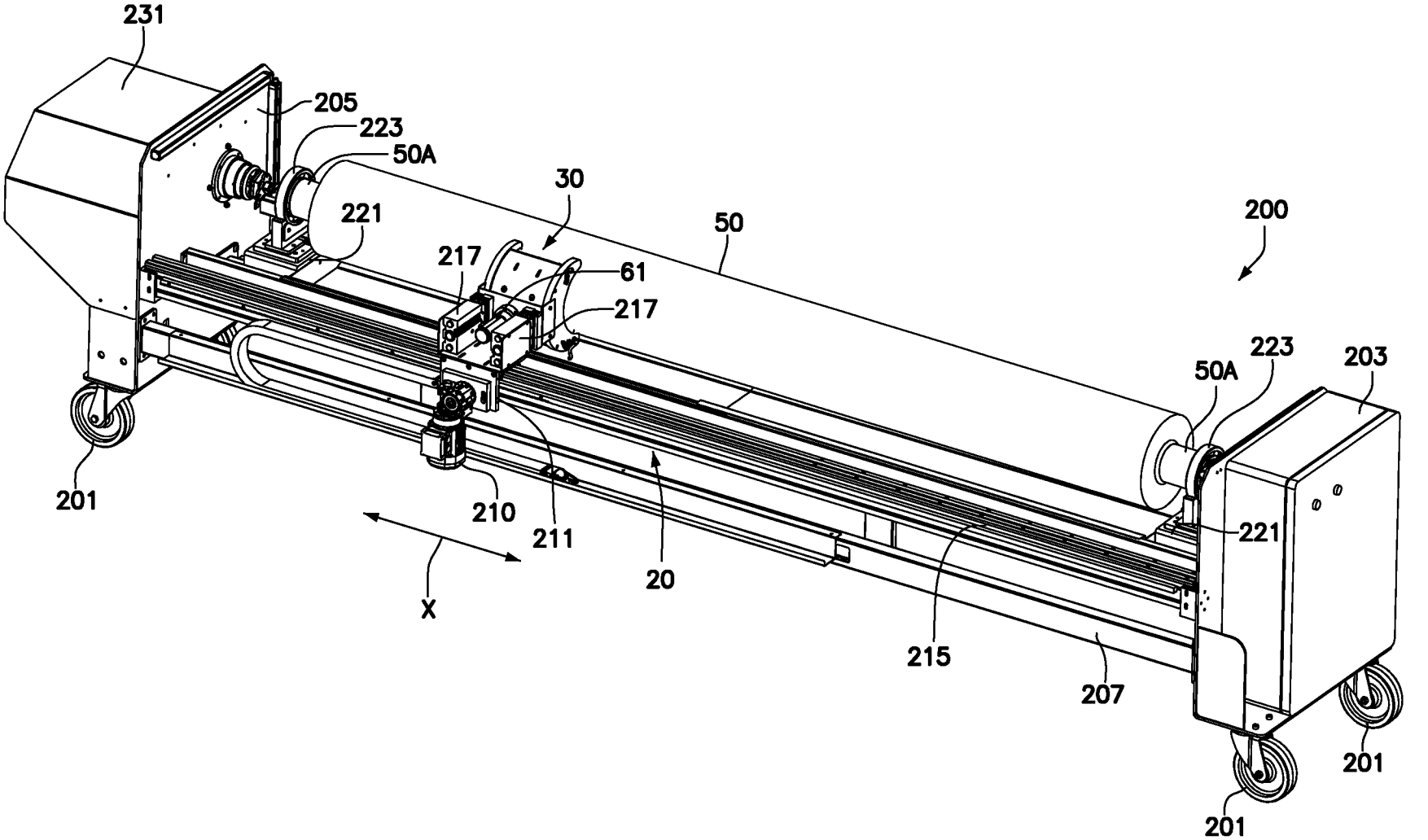
Figure 9A:
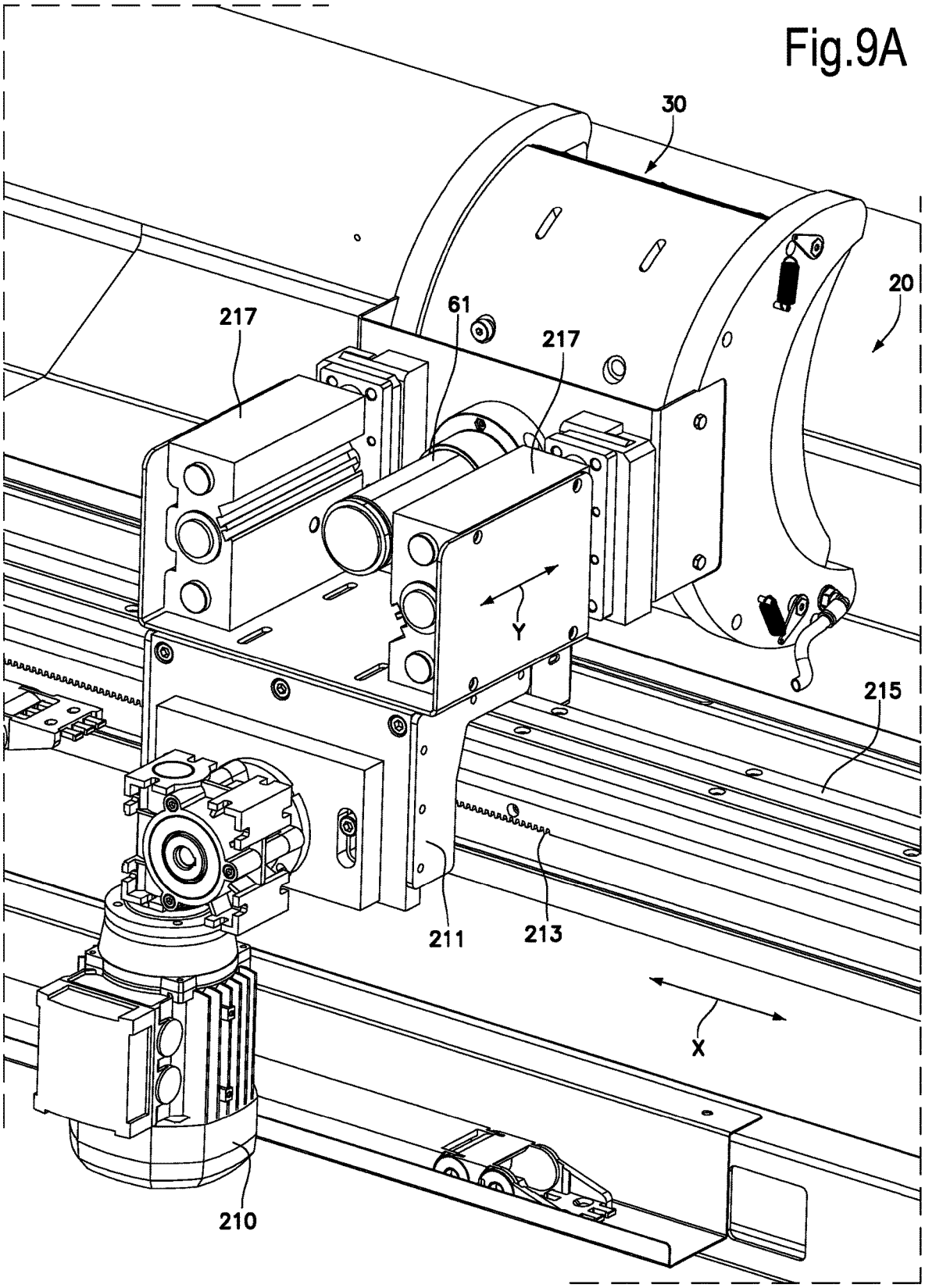
FIG. 9A is an enlargement of the cleaning head of FIG. 9.
Figure 10:
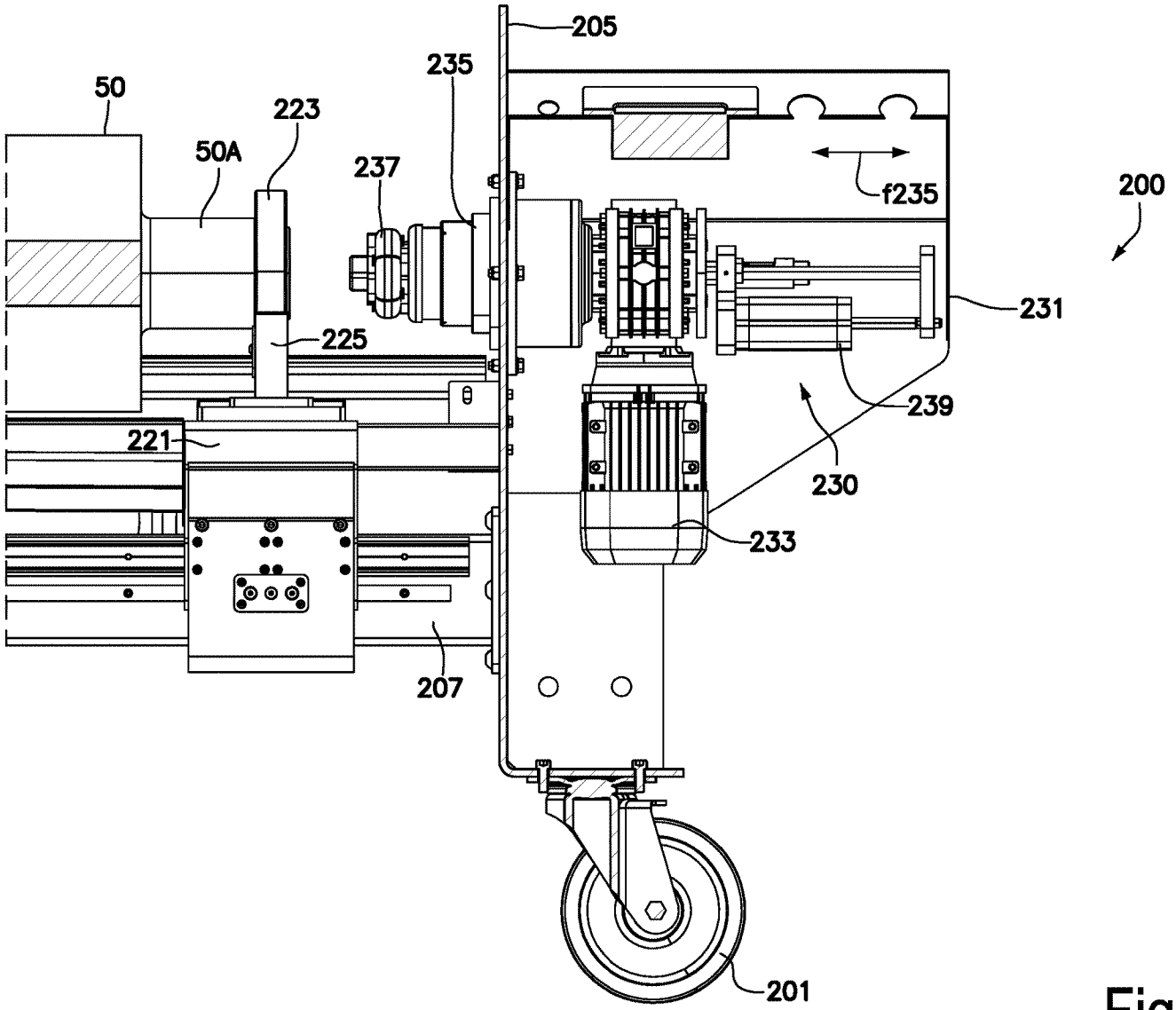
FIG. 10 is an isometric view with parts removed of a detail of FIGS. 8 and 9.

The cleaning head 30 is movable with respect to the slide 211 in a direction orthogonal to arrow X, in order to approach a roller 50 and move away therefrom. This movement is pictorially represented by double arrow Y (FIG. 9A). The movement according to double arrow Y can be controlled by one or more actuators. In the embodiment of FIGS. 8, 9 and 10 two cylinder-piston actuators 217 are provided to control the movement according to double arrow Y. Between the two actuators 217 an actuator 61 (for instance a pneumatic motor) can be positioned, which is adapted to control the movement of the cleaning member 60. This latter can be configured and operated as described above in relation to FIGS. 1 to 7.

On the beams 207 two supporting carriages 221 can be arranged, which are adapted to support the roller 50. At least one or both carriages 221 can be movable parallel to the beams 207 to adjust the distance therebetween according to the axial length of the roller 50. In some embodiments, one or both carriages 221 can be provided with actuators to adjust their position, for example electric motors and relevant transmission means, such as a rack-and-pinion arrangement, or else a threaded bar and nut arrangement or the like.

In some embodiments the roller 50 can be provided with journals 50A. Each journal 50A can in turn have a respective bearing 223 mounted thereon. The bearings 223 are intended to rotatingly support the roller 50 in the printing machine where the roller 50 is used and are removed along with the roller 50 when this latter shall be cleaned. The same bearings 223 are thus used to support the roller 50 during cleaning. Each carriage 221 can be provided with a respective cradle 225 (see FIG. 10), on which the respective bearing 223 rests when the roller 50 is positioned in the cleaning machine 200.

In some embodiments the cradles 225 can be interchangeable, to adapt to journals 50A of variable diameter. Moreover, the mutual distance between the supporting carriages 221 can be adjusted to the axial length of the roller 50 to be cleaned, as mentioned above.

In some embodiments, the cleaning machine 200 includes a driving unit 230 to drive the roller 50 into rotation around the axis thereof, while the roller 50 is supported via bearings 223 on the cradles 225. In the embodiment of FIGS. 8 to 10 the driving unit is associated with the end unit 205. An embodiment of the driving unit is shown in detail in FIG. 10. In this embodiment, the driving unit 230 is housed in a housing 231. The driving unit 230 can include a rotary motor, for instance an electric motor 233, which controls rotation of a spindle 235. This latter is collinear with the roller 50 to be cleaned when the roller is placed on the cradles 225.

The spindle 235 is provided with a roller engaging member 237. In some embodiments the roller engaging member 237 comprises a magnetic device, for instance including an electromagnet. The electromagnet can be energized when coupling of the spindle 235 to the roller 50 is required.

The spindle 235 is further provided with an approaching and withdrawal movement parallel to the spindle axis, i.e. parallel to the rotation axis of the roller 50 to be cleaned. The approaching and withdrawal movement is pictorially represented by double arrow f235. The movement according to double arrow f235 can be controlled by an actuator, such as a linear actuator, for instance a cylinder-piston 239.

Operation of the cleaning machine 200 is as follows. The carriages 221 are adjusted in the correct position according to the axial length of the roller 50. Thereafter, the roller 50 to be cleaned is placed with the bearings 223 thereof on the cradles 225. The cleaning head 30 of the cleaning device 20 is moved close to the roller 50 by means of actuators 217 and the spindle 235 is axially moved against the roller journal 50A facing the spindle. The engaging member 237 forming the spindle head is energized such that the spindle 235 becomes drivingly coupled to the roller 50.

The roller 50 is put into rotation around the rotation axis thereof and the cleaning head 30 is activated to clean the roller 50 as described in connection with FIGS. 1 to 7.

When the roller 50 has been cleaned, the reverse operations are performed.

The roller 50 can placed on the cleaning machine 200 and removed therefrom with any suitable means, such as a crane, an overhead crane, a fork carriage or the like. The cleaning machine 200 can be moved close to the printing machine wherefrom the roller 50 to be cleaned is removed and/or where the cleaned roller 50 shall be mounted.

Figure 11:
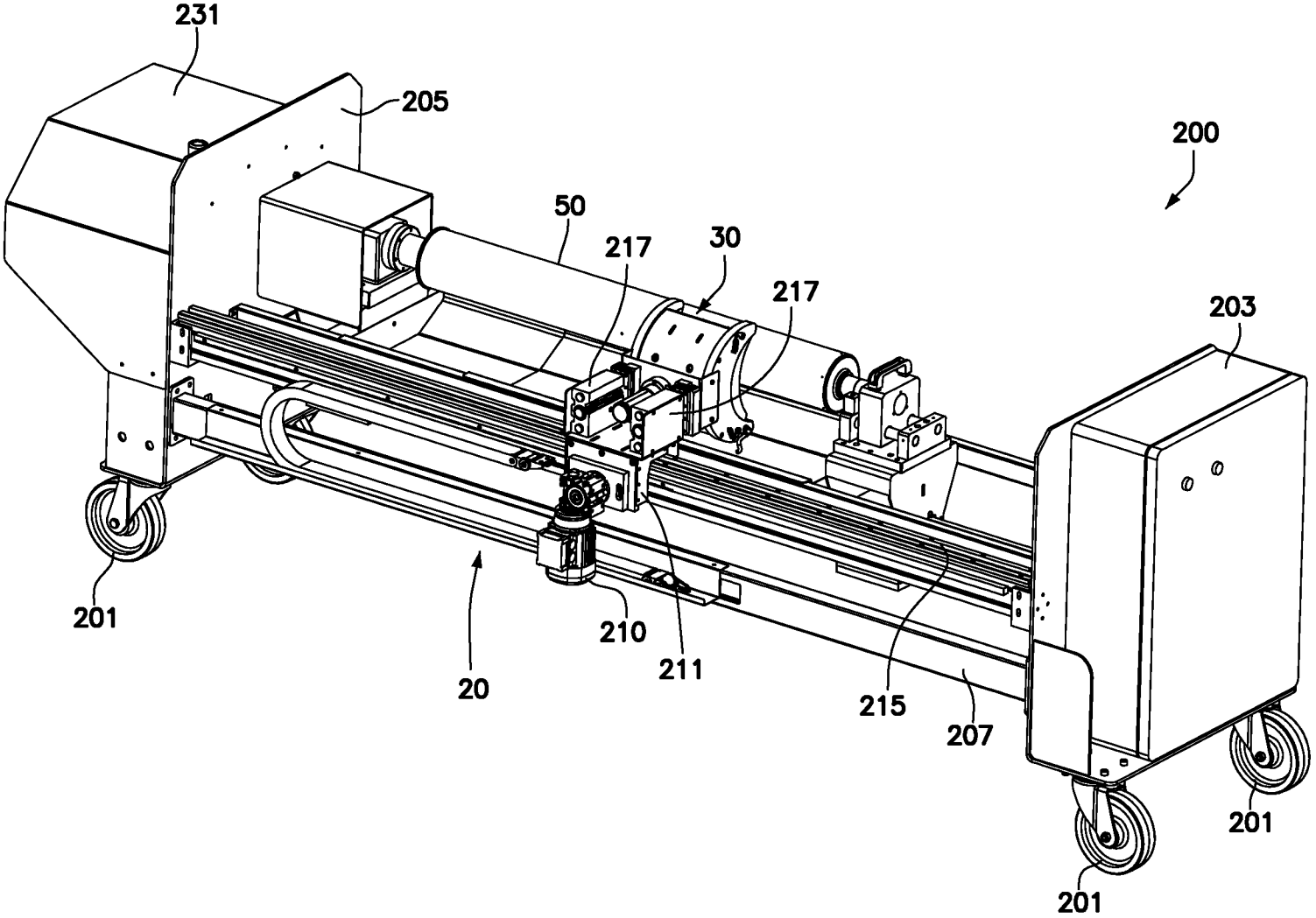
FIGS. 11 and 12 are two isometric views of a machine according to a yet further embodiment.
Figure 12:
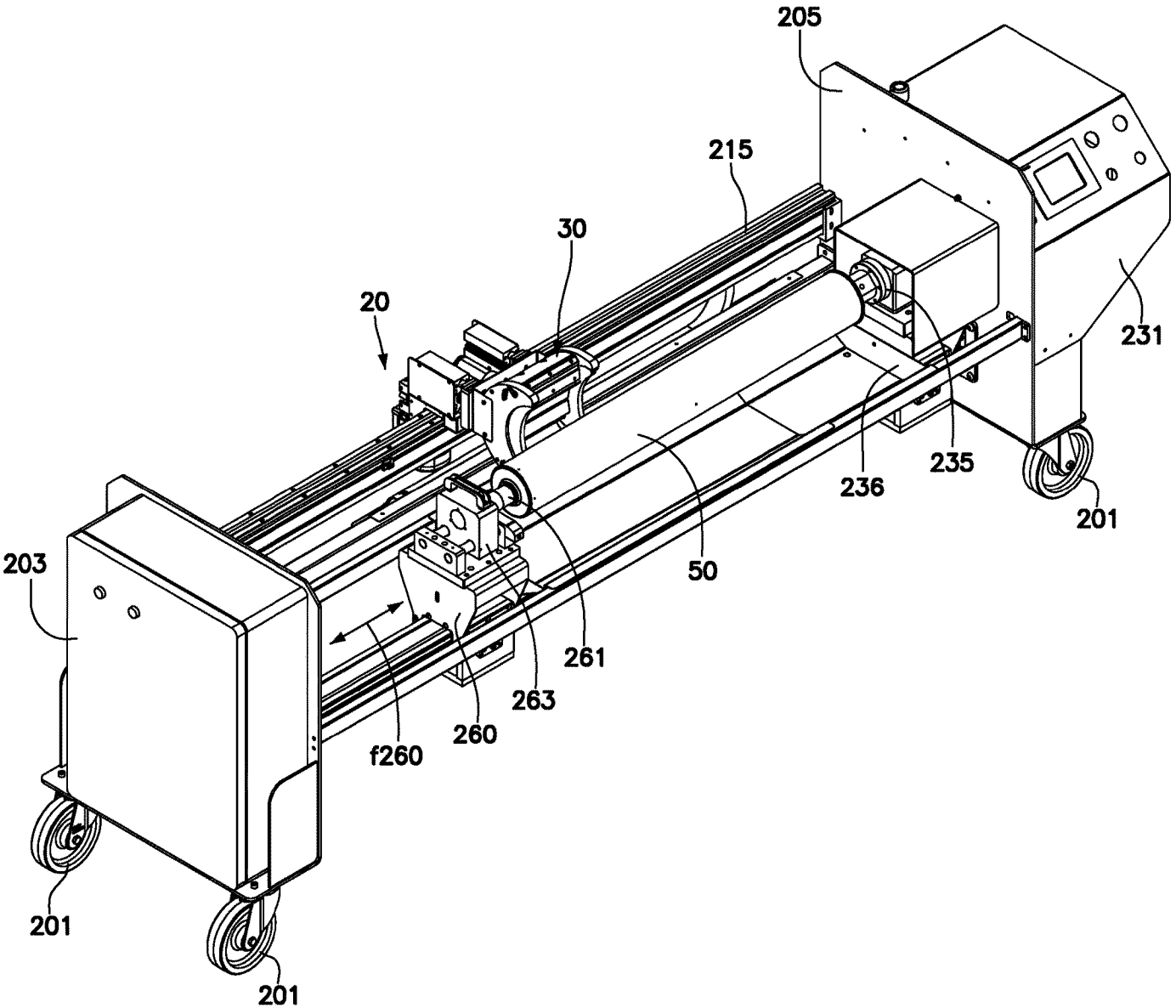

FIGS. 11 and 12 illustrate isometric views of another embodiment of the cleaning machine 200, which is particularly adapted to clean rollers in the form of cylindrical sleeves. Such cylindrical sleeves are often used in printing machines for easy replacement. Rather than replacing a monolithic solid roller, the roller is shaped as a hollow sleeve and is mounted on an inner core. Locking members, such as mechanical, hydraulic or pneumatic locking members (known per se) are used to axially and torsionally lock the sleeve on the core.

The same reference numbers designate the same or equivalent parts as those described above. The cleaning head 30 can be configured as described in connection with FIGS. 1 to 7. The cleaning device 20 including the cleaning head 30 can be configured as described in connection with FIGS. 8-10.

The main difference between the cleaning machine 200 of FIGS. 8-10 and the cleaning machine 200 of FIGS. 11, 12 concerns the manner in which the roller to be cleaned is mounted on the cleaning machine 200. The difference takes into account the fact that the roller 50 in this embodiment is in the form of a cylindrical hollow sleeve, which is not provided with roller journals and relevant bearings. Different roller supporting devices are thus provided in this case.

In the embodiment of FIGS. 11 and 12 the roller or sleeve 50 is drivingly coupled at one end to the spindle 235. The opposite end of the roller or sleeve 50 can be engaged by an opposite shaft 261, which can be idly supported on a slide 263, in turn mounted on a carriage 260. The carriage 260 can be movable according to double arrow f260, to adjust the distance between the carriage 260 and the spindle 230. The movement of the slide 263 with respect to the carriage 260 can be in the same direction represented by double arrow f260 and can be used to lock and unlock the shaft 261 with respect to the sleeve 50. This makes locking and unlocking faster and independent of the position of the carriage 260 with respect to the supporting beams 207.

The operation of the cleaning machine 200 of FIGS. 11 and 12 is substantially the same as described above in respect of the cleaning machine 200 of FIGS. 8-10.

Several modifications and changes can be implemented on the cleaning machine 200 of FIGS. 8 to 12. For instance, the spindle 235 in FIGS. 11 and 12 can be arranged on a slide 236, rather than being housed inside the housing 231. The slide 236 may support a motor, for instance an electric, hydraulic or pneumatic motor (not shown) adapted to drive into rotation the spindle 235. The carriage 236 can be stationary or movable along beams 207.

The spindle 235 in FIGS. 11, 12 can be equipped with a magnetic coupling feature, to co-act with the sleeve or roller 50.

In other embodiments, the spindle 235 can be drivingly coupled to the roller 50 or to a sleeve 50 with different means, for instance mechanical means rather than magnetic means. A magnetic coupling may be beneficial in terms of easy operation and flexibility, since it can be used for rollers of variable shapes. Locking and unlocking does not require actuation of mechanical means, Actuation is faster and reduces wearing of the mechanical components.

The cleaning head 30 can be easily replaced with a different cleaning head, for instance a dry-cleaning head.

The invention claimed is:

1. A cleaning device for cleaning a cylindrical roller having a longitudinal roller axis and a cylindrical side surface, the cleaning device comprising:

a cleaning head with a cleaning chamber;

sealing blades extending parallel to the roller axis and lateral sealing gaskets extending transversely to the roller axis, the sealing blades and the lateral sealing gaskets closing the cleaning chamber, the lateral sealing gaskets having concave edges configured to sealingly contact the cylindrical side surface of the roller;

a mechanical cleaning member housed in the cleaning chamber;

a first actuator configured to move the mechanical cleaning member inside the cleaning chamber;

cleaning liquid feeding members configured to feed a cleaning liquid into the cleaning chamber; wherein the mechanical cleaning member and the cleaning liquid fed by said feeding members work in combination inside said cleaning chamber; wherein the cleaning head is provided with a translation movement in a direction parallel to the roller axis of the cylindrical roller; wherein the first actuator is configured to move the mechanical cleaning member with respect to the cleaning chamber while maintaining the mechanical cleaning member in contact with the cylindrical side surface of the roller.

2. Device according to claim 1, further comprising a second actuator configured to move the cleaning head toward and away from the roller.

3. Device according to claim 1, wherein the first actuator is configured to move the mechanical cleaning member inside the cleaning chamber with a reciprocating movement.

4. Device according to claim 1, wherein the first actuator is configured to move the mechanical cleaning member inside the cleaning chamber with a reciprocating movement parallel to the roller axis.

5. Device according to claim 1, wherein said mechanical cleaning member is provided with a movement, with respect to the cleaning chamber, toward or away from the roller.

6. Device according to claim 1, wherein the lateral sealing gaskets are elastically yielding to adapt to the cylindrical side surface of the roller to be cleaned.

7. Device according to claim 1, wherein the lateral sealing gaskets are housed in respective side elements, said side elements being adapted to house lateral sealing gaskets of variable dimensions, as a function of a diameter of said roller to be cleaned.

8. Device according to claim 7, wherein the side elements are adapted to house lateral sealing gaskets replaceable to cover a range of diameters of the roller to be cleaned comprised between 150 and 220 mm, or between 220 and 300 mm.

9. Device according to claim 7, wherein the sealing blades are held with pressure on the roller to be cleaned through pressure members, and wherein the sealing blades are supported by said side elements.

10. Device according to claim 1, wherein the cleaning chamber is made fluid tight, through a combination of said lateral sealing gaskets and of said sealing blades in cooperation with the cylindrical side surface of the roller to be cleaned.

11. Device according to claim 1, wherein the concave edges of the lateral sealing gaskets comprise lateral chambers that are open toward the cylindrical side surface of the roller to be cleaned.

12. Device according to claim 11, wherein nozzles for feeding a rinsing liquid open into the lateral chambers.

13. Device according to claim 1, wherein the mechanical cleaning member comprises at least a brush.

14. Device according to claim 1, wherein the mechanical cleaning member is divided into at least two parts separated along a channel parallel to the roller to be cleaned.

15. Device according to claim 1, wherein the mechanical cleaning member has two active surfaces adapted to act on the roller to be cleaned, which are mutually inclined to form a V-shaped surface with the vertex oriented toward the inside of the cleaning chamber.

16. The cleaning machine of claim 1, wherein the cleaning head is configured to be actuated independent of actuation of the mechanical cleaning member, and wherein no portion of the mechanical cleaning member extends outside of the cleaning head.

17. The cleaning device of claim 1, wherein the lateral sealing gaskets are replaceable as a function of the diameter of the roller to be cleaned.

18. A method for cleaning a first roller, comprising the following steps:

providing a cleaning device according to claim 1;

moving the cleaning head toward a lateral cylindrical surface of the first roller;

bringing the mechanical cleaning member into contact with the lateral cylindrical surface of the first roller to be cleaned;

moving the mechanical cleaning member with respect to the lateral cylindrical surface of the first roller while the mechanical cleaning element is in contact with the lateral cylindrical surface of the first roller; and dispensing cleaning liquid into the cleaning chamber.

19. The method of the claim 18, wherein the step of moving the mechanical cleaning member in contact with the lateral cylindrical surface of the first roller comprises a step of translating the mechanical cleaning member with alternating movement parallel to a longitudinal axis of the first roller.

20. The method of claim 18, further comprising a step of rotating the first roller about a longitudinal axis of the first roller while the mechanical cleaning member acts on the lateral cylindrical surface of the first roller.

21. The method of the claim 18, further comprising a step of gradually translating the cleaning head along a longitudinal axis of the first roller to clean the whole lateral cylindrical surface of the first roller.

22. A cleaning machine comprising:

a supporting structure;

on said supporting structure, supporting devices for supporting a cylindrical roller to be cleaned, wherein the cylindrical roller comprises a longitudinal roller axis and a cylindrical side surface;

a driving unit adapted to drive the roller into rotation when the roller is supported on the supporting devices;

a cleaning device comprising:

a cleaning head with a cleaning chamber;

sealing blades extending parallel to the roller axis and lateral sealing gaskets extending transversely to the roller axis, the sealing blades and the lateral sealing gaskets closing the cleaning chamber, the lateral sealing gaskets having concave edges configured to sealingly contact the cylindrical side surface of the roller;

a mechanical cleaning member housed in the cleaning chamber;

a first actuator configured to move the mechanical cleaning member inside the cleaning chamber;

cleaning liquid feeding members configured to feed a cleaning liquid into the cleaning chamber, wherein the mechanical cleaning member and the cleaning liquid fed by the feeding members work in combination inside the cleaning chamber, the cleaning head being provided with a translation movement in a direction parallel to the roller axis of the cylindrical roller, the first actuator being configured to move the mechanical cleaning member with respect to the cleaning chamber while maintaining the mechanical cleaning member in contact with the cylindrical side surface of the roller.

23. The cleaning machine of claim 22, further comprising wheels adapted to displace the cleaning machine.

24. The cleaning machine of claim 22, wherein the driving unit comprises a rotating spindle adapted to selectively engage and disengage the roller and a magnetic engaging device to torsionally connect the spindle to the roller.

25. The cleaning machine of claim 22, wherein the cleaning head is configured to be actuated independent of actuation of the mechanical cleaning member, and wherein no portion of the mechanical cleaning member extends outside of the cleaning head.

* * * * *